US011225273B2

(12) United States Patent
Wike

(10) Patent No.: US 11,225,273 B2
(45) Date of Patent: Jan. 18, 2022

(54) RAILWAY TRUCK ASSEMBLY HAVING CORELESS I-BEAM BOLSTER

(71) Applicant: Amsted Rail Company, Inc., Chicago, IL (US)

(72) Inventor: Paul Steven Wike, St. Louis, MO (US)

(73) Assignee: Amsted Rail Company, Inc., Chicago, IL (US)

( * ) Notice: Subject to any disclaimer, the term of this patent is extended or adjusted under 35 U.S.C. 154(b) by 357 days.

(21) Appl. No.: 16/556,374

(22) Filed: Aug. 30, 2019

(65) Prior Publication Data

US 2020/0017128 A1 Jan. 16, 2020

Related U.S. Application Data

(63) Continuation-in-part of application No. 16/509,658, filed on Jul. 12, 2019.

(60) Provisional application No. 62/698,358, filed on Jul. 16, 2018.

(51) Int. Cl.
*B61F 5/52* (2006.01)
*B61F 3/02* (2006.01)

(52) U.S. Cl.
CPC . *B61F 5/52* (2013.01); *B61F 3/02* (2013.01)

(58) Field of Classification Search
CPC ..... B61F 5/52; B61F 3/02
See application file for complete search history.

(56) References Cited

U.S. PATENT DOCUMENTS

| | | | | | |
|---|---|---|---|---|---|
| 595,617 | A * | 12/1897 | Gallagher | B61F 5/52 | 105/202 |
| 1,757,388 | A * | 5/1930 | Rendleman | E04C 3/06 | 52/837 |
| 5,410,968 | A * | 5/1995 | Hawthorne | B61F 5/52 | 105/206.1 |
| 5,546,869 | A * | 8/1996 | Nassar | B61F 5/52 | 105/206.1 |
| 7,527,131 | B1 * | 5/2009 | Wike | B61H 13/36 | 188/219.6 |
| 2012/0318166 | A1 * | 12/2012 | Wike | B61F 5/127 | 105/198.2 |
| 2014/0261064 | A1 * | 9/2014 | Wike | B61F 5/28 | 105/198.4 |
| 2016/0059870 | A1 * | 3/2016 | Wike | B61F 5/122 | 105/198.4 |
| 2017/0158209 | A1 * | 6/2017 | Wike | B61F 5/04 | |
| 2018/0162424 | A1 * | 6/2018 | Aleynikov | B61F 5/122 | |
| 2020/0017127 | A1 * | 1/2020 | Wike | E04C 3/06 | |
| 2020/0017128 | A1 * | 1/2020 | Wike | B61F 5/52 | |

FOREIGN PATENT DOCUMENTS

GB 1415331 A * 11/1975 ..... E04C 3/06

* cited by examiner

*Primary Examiner* — Jason C Smith
(74) *Attorney, Agent, or Firm* — The Small Patent Law Group LLC; Joseph M. Butscher

(57) ABSTRACT

A truck assembly is configured to travel along a track having rails. The truck assembly includes a bolster that includes a first flange, a second flange, and a web connecting the first flange to the second flange. The first flange, the second flange, and the web form an I-beam.

21 Claims, 11 Drawing Sheets

RAILWAY TRUCK ASSEMBLY HAVING CORELESS I-BEAM BOLSTER

RELATED APPLICATIONS

This application is a continuation-in-part of U.S. patent application Ser. No. 16/509,658, filed Jul. 12, 2019, which, in turn, relates to and claims priority benefits from U.S. Provisional Patent Application No. 62/698,358, filed Jul. 16, 2018, which is hereby incorporated by reference in its entirety.

FIELD OF THE DISCLOSURE

Embodiments of the present disclosure generally relate to truck assemblies for rail vehicles, such as rail cars, and, more particularly, to truck assemblies that include one or more components having at least portions formed as I-beams.

BACKGROUND OF THE DISCLOSURE

Rail vehicles travel along railways, which have tracks that include rails. A rail vehicle includes one or more truck assemblies that support one or more car bodies. Each truck assembly includes two side frames and a bolster. Friction shoes are disposed between the bolster and the side frames. The friction shoes are configured to provide damping for suspension.

Typically, the side frames are formed having a hollow box or tubular construction. Risers, runners, and other such structures are used during the manufacturing process to form the side frames. Further, the side frames are supported with rigging during the manufacturing process. In general, the process of forming the side frames is time- and labor-intensive, as well as costly.

Further, a typical bolster has a box section including various internal ribs and webs. The bolster is formed of cast steel, which is manufactured through a sand molding process. The sand molding process to form a bolster with internal ribs and webs is also time- and labor-intensive, as well as costly. Exterior features of the bolster are imprinted in top and bottom exterior molds. An internal space of the box section of the bolster typically requires internal sand cores to provide an internal void in relation to box-shaped walls. The internal ribs and webs also typically require sand cores to form a void. The sand cores generally require spacers, referred to as rigging, to properly hold them in place during the casting process. Once the casting is completed, the sand cores and remainder of the rigging are removed. Moreover, the forming process includes grinding the cast bolster to remove flashing and any remaining rigging.

Certain side frames have been formed with a tapering I-beam construction. Such side frames are rigid in the vertical direction, but are susceptible to twisting when a transverse load is exerted therein.

An I-shaped cross section is an efficient form for carrying both bending and shear loads in a plane of a web. However, the cross-section also has a reduced capacity in the transverse direction, and, as noted, is inefficient in relation transverse loads. As vertical force is exerted, a traditional I-beam deflects in a vertical plane. However, with the addition of transverse force, the traditional I-beam may bend out of the vertical plane, and cause the traditional I-beam to buckle and/or twist.

Accordingly, side frames and bolsters of railway truck assemblies are typically formed as hollow box or tubes, in contrast to I-beams. As noted, however, the process of forming hollow box or tubular side frames and bolsters is time- and labor-intensive, as well as costly.

SUMMARY OF THE DISCLOSURE

A need exists for a railway truck assembly having components, such as side frames and bolsters, that may be efficiently formed. Further, a need exists for a railway truck assembly having components that are robust and reliable. Moreover, a need exists for an I-beam that efficiently carries bending and shear loads in a plane of a web, as well as an increased capacity in a transverse direction.

With those needs in mind, certain embodiments of the present disclosure provide an I-beam including a web having a first end and a second end opposite from the first end, a first flange extending from the first end of the web, and a second flange extending from the second end of the web. A thickness of the web increases away from a first neutral axis towards the first flange and the second flange. The thickness of the web may uniformly increase from the first neutral axis towards the first flange and the second flange. In at least one embodiment, the web at the first neutral axis is a thinnest portion of the web.

In at least one embodiment, a thickness of the first flange increases away from a second neutral axis towards first distal edges of the first flange. The first neutral axis may be orthogonal to the second neutral axis. In at least one embodiment, the first flange at the second neutral axis is a thinnest portion of the first flange.

In at least one embodiment, a thickness of the second flange increases away from the second neutral axis towards second distal edges of the second flange. In at least one embodiment, the second flange at the second neutral axis is a thinnest portion of the second flange.

Certain embodiments of the present disclosure provide a method of forming an I-beam. The method includes extending a first flange from a first end of a web, extending a second flange from a second end of the web (wherein the second end is opposite from the first end), and increasing a thickness of the web away from a first neutral axis towards the first flange and the second flange.

In at least one embodiment, the method also includes a thickness of the first flange away from a second neutral axis towards first distal edges of the first flange. In at least one embodiment, the method also includes increasing a thickness of the second flange away from the second neutral axis towards second distal edges of the second flange.

Certain embodiments of the present disclosure provide a truck assembly that is configured to travel along a track having rails. The truck assembly includes a first side frame, a second side frame, and a bolster extending between the first side frame and the second side frame. One or more of the first side frame, the second frame, or the bolster includes at least a portion formed as an I-beam, as described herein.

Certain embodiments of the present disclosure provide a bolster for a truck assembly. The truck assembly is configured to travel along a track having rails. The bolster includes a first flange, a second flange, and a web connecting the first flange to the second flange. the first flange, the second flange, and the web form an I-beam.

In at least one embodiment, the bolster also includes one or more gussets extending between the first flange and the second flange. The gusset(s) may connect to the web. The gusset(s) may be orthogonal to the web. The gusset(s) may expand from a central portion towards a first junction with the first flange and a second junction with the second flange.

The gusset(s) may extend to outer edges of one or both of the first flange or the second flange.

In at least one embodiment, the bolster further includes a first shoe pocket formed at a first end. The first shoe pocket is configured to receive and retain a first friction shoe. A second shoe pocket is at a second end. The second shoe pocket is configured to receive and retain a second friction shoe.

In at least one embodiment, a thickness of the web increases away from a first neutral axis towards the first flange and the second flange. In at least one embodiment, a thickness of the first flange increases away from a second neutral axis towards first distal edges of the first flange. In at least one embodiment, a thickness of the second flange increases away from the second neutral axis towards second distal edges of the second flange.

Certain embodiments of the present disclosure provide a method of forming a bolster for a truck assembly. The truck assembly is configured to travel along a track having rails. The method includes integrally forming the bolster with a first flange, a second flange, and a web. The integrally forming provides an I-beam.

The method may also include extending one or more gussets between the first flange and the second flange. The extending may include connecting the gusset(s) to the web. The extending may include orthogonally disposing the gusset(s) in relation to the web. The extending may include expanding the gusset(s) from a central portion towards a first junction with the first flange and a second junction with the second flange. The extending may include extending the gusset(s) to outer edges of one or both of the first flange or the second flange.

The method may further include forming a first shoe pocket at a first end of the bolster. The first shoe pocket is configured to receive and retain a first friction shoe. The method may also include forming a second shoe pocket at a second end of the bolster. The second shoe pocket is configured to receive and retain a second friction shoe.

Certain embodiments of the present disclosure provide a truck assembly that is configured to travel along a track having rails. The truck assembly includes a first side frame, a second side frame, and a bolster extending between the first side frame and the second side frame, as described herein.

DETAILED DESCRIPTION OF THE DISCLOSURE

Figure 1:
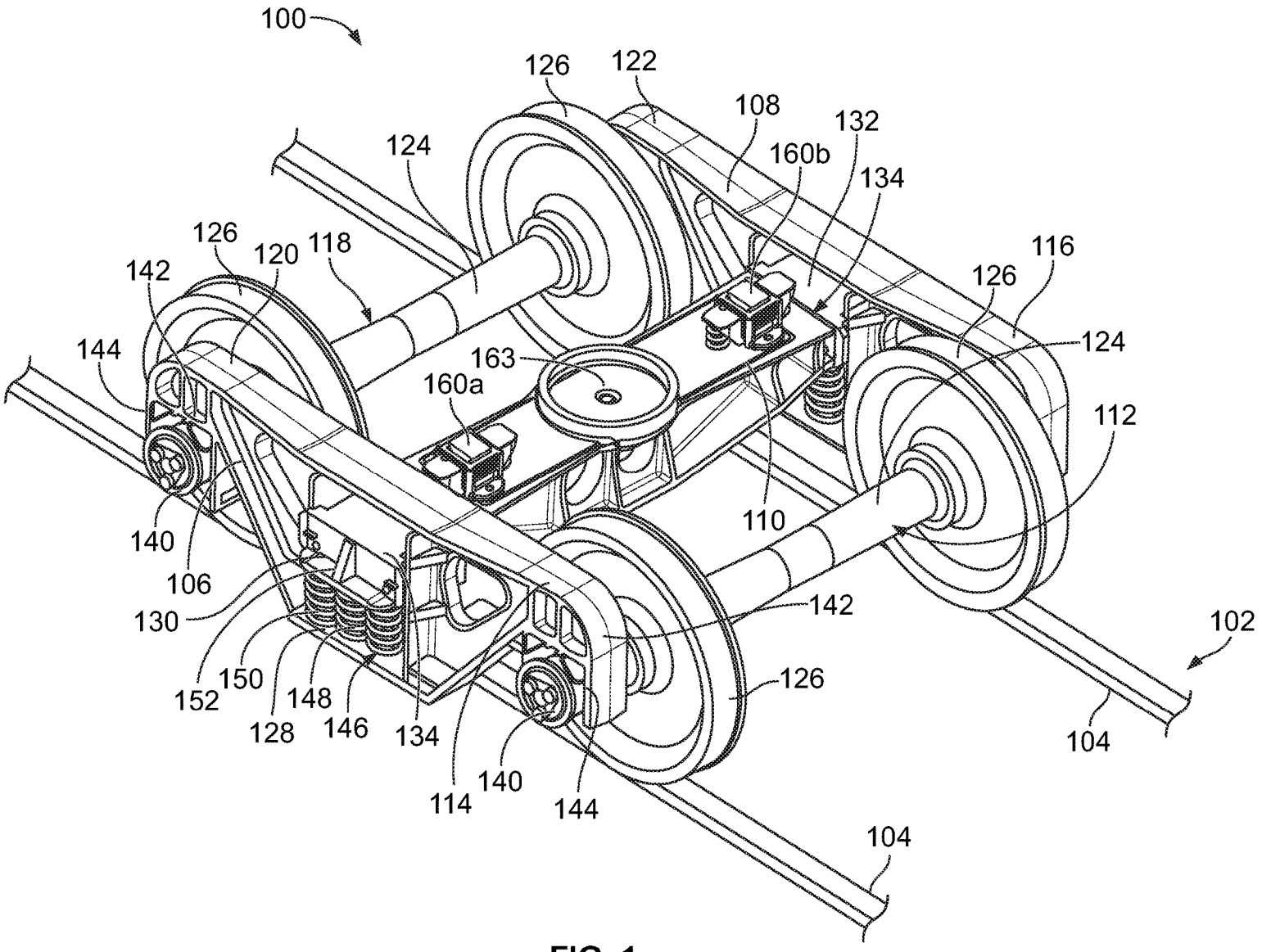
FIG. 1 illustrates a perspective top view of a truck assembly.

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a bolster having at least portions formed as an I-beam. The bolster includes a first flange coupled to a second flange through a web. One or more stiffening gussets may extend between the first flange and the second flange. Shoe pockets may be formed in ends of the bolster. The shoe pockets are configured to receive and retain friction shoes.

Certain embodiments of the present disclosure provide an I-beam including a web coupled to at least one flange. A thickness of the web outwardly expands away from a first neutral axis. That is, the thickness outwardly expands away from the first neutral axis. Further, a thickness of the flange(s) outwardly expands from a second neutral axis, which may be orthogonal to the first neutral axis. In at least one embodiment, a truck assembly has one or more components having at least portions formed as I-beams that outwardly expand (for example, increase in thickness) away from at least one neutral axis.

The outward expansion of portions of the I-beam away from a neutral axis distributes stresses over larger areas. As such, the stresses may be evenly and uniformly distributed throughout the I-beam, instead of being variably exerted at different locations. In this manner, the I-beam may be a constant stress I-beam. Components (such as side frames and bolsters) of railway truck assemblies formed of such I-beams evenly and uniformly distribute stresses therethrough. The components outwardly expand (that is, increase in thickness) away from at least one neutral axis, thereby effectively and efficiently withstanding vertical and transverse forces that may otherwise twist traditional I-beams.

Typically, when loads are exerted into an I-beam, compressive and tensile forces are developed. The compressive and tensile forces induce stresses into the beam. A maximum compressive stress may be at an uppermost most edge of the I-beam while a maximum tensile stress may be located at a lower most edge of the I-beam. Because the stresses between such opposing stresses is linear, there is a point on the linear path between them where there is no bending stress, which is known as a neutral axis.

The neutral axis within a cross-section of a beam is an axis in which there are no longitudinal stresses or strains. Stated differently, the neutral axis is a line in a beam or other such structure subjected to bending in which fibers are neither stretched, nor compressed, or where the longitudinal stress is zero.

Certain embodiments of the present disclosure provide a bolster having an I-beam cross section. The bolster may be formed without a core (that is, a coreless bolster). In contrast, conventional box-section bolsters are formed with or having cores. Further, in contrast to conventional box-section bolsters, exterior molds with void imprinted features are used to form the bolster (without the need of cores), thereby providing an efficient manufacturing process that is substantially less costly and less time-consuming as compared to the process of forming conventional box-section bolsters.

In at least one embodiment, the coreless bolster has a beam shape including flanges connected by a web. The relationship of the web and flange shapes is configured to meet structural loads and endurance requirements. The coreless bolster is configured for vertical as well as transverse loads without twisting out of plane. Out-of-plane twisting is eliminated, minimized, or otherwise reduced through stiffening gussets. Further, the coreless bolster eliminates, minimizes, or otherwise reduces a need for accurately locating a sloped wall for friction shoes. In at least one embodiment, open shoe pockets are formed in ends of the bolster. Friction shoes may be positioned within the shoe pockets.

Embodiments of the present disclosure provide an efficient method for manufacturing a bolster, which reduces manufacturing cost due to elimination of internal cores and associated rigging. Further, the coreless bolster allows most, if not all, surfaces to be visibly inspected for any imperfections, which is typically not possible with the box section bolsters. Additionally, the shoe pockets receive friction shoes that do not require accurately-located sloped walls, which also eliminates the need for cores in those areas.

FIG. 1 illustrates a perspective top view of a truck assembly 100. The truck assembly 100 is configured to travel along a track 102 having rails 104. The truck assembly 100 includes a first side frame 106 and a second side frame 108, which are spaced apart from one another. A bolster 110 extends between the first side frame 106 and the second side frame 108, and couples the first side frame 106 to the second side frame 108.

A first wheel set 112 is rotatably coupled to first ends 114 and 116 of the first side frame 106 and the second side frame 108, respectively, and a second wheel set 118 is rotatably coupled to second ends 120 and 122 of the first side frame 106 and the second side frame 108, respectively. Each of the first and second wheel sets 112 and 118 includes an axle 124 connected to wheels 126. The wheels 126 are supported on the rails 104 and are configured to travel thereon as the axles 124 rotate in relation to the first side frame 106 and the second side frame 108.

The first and second side frames 106 and 108 includes damper or damping systems 128. For example, the damper systems 128 include one or more springs, friction shoes, and the like that are configured to dampen forces exerted into and/or by the truck assembly 100 as the truck assembly 100 travels along the track 102.

The bolster 110 includes ends 130 and 132 (for example a first end 130 and an opposite second end 132), which extend through openings 134 of the side frames 106 and 108. The bolster 110 also includes a bolster center bowl 136 outwardly extending from an upper surface 138. As shown, the bolster center bowl 136 is centrally located on the upper surface 138 of the bolster 110 between the ends 130 and 132.

Ends of the axles 124 are rotatably retained by bearings 140, which are coupled to the side frames 106 and 108. In particular, the wheel sets 112 and 118 are coupled to the side frames 106 and 108 at pedestals 142 of the side frames 106 and 108. The pedestals 142 connect to bearing adapters 144 that connect to the bearings 140.

In at least one embodiment, the damping systems 128 include spring groups 146 supported within the openings 134 of the side frames 106 and 108. The spring groups 146 include load coils 148 and control coils 150. The load coils 148 support the bolster 110 at the ends 130 and 132. The control coils 150 support friction shoes 152.

A side bearing assembly 160*a* is mounted on the top surface 138 of the bolster 110 between the bolster center bowl 136 and the end 130. A second side bearing assembly 160*b* is mounted on the top surface 138 of the bolster 110 between the bolster center bowl 136 and the end 132. The side bearing assembly 160*a* and the side bearing assembly 160*b* may be aligned along a central longitudinal plane of the bolster 110 that passes through a center 163 of the bolster center bowl 136. Each side bearing assembly 160*a* and 160*b* may be spaced from the center 163 the same distance, but in opposite directions.

The side bearing assemblies 160*a* and 160*b* are configured to limit roll of a car body supported by the truck assembly 100, thereby increasing the stability of the car body and the truck assembly 100, as well as a rail vehicle that includes the car body and the truck assembly 100.

In at least one embodiment, one or more portions of a truck assembly, such as the truck assembly 100, are formed as I-beams that outwardly expand (that is, increase in thickness) away from at least one neutral axis. For example, one or both of the first side frame 106 and/or the second side frame 108 may have at least portions formed as I-beams that outwardly expand away from at least one neutral axis. As another example, the bolster 110 may have at least a portion formed as an I-beam that outwardly expands away from at least one neutral axis. In at least one embodiment, the bolster 110 is formed without the use of a core, and includes portions formed as I-beams. Alternatively, portions of the truck assembly may be formed as I-beams that may not outwardly expand away from at least one neutral axis. For example, the bolster 110 may include portions of I-beams that may or may not outwardly expand away from at least one neutral axis.

Figure 2:
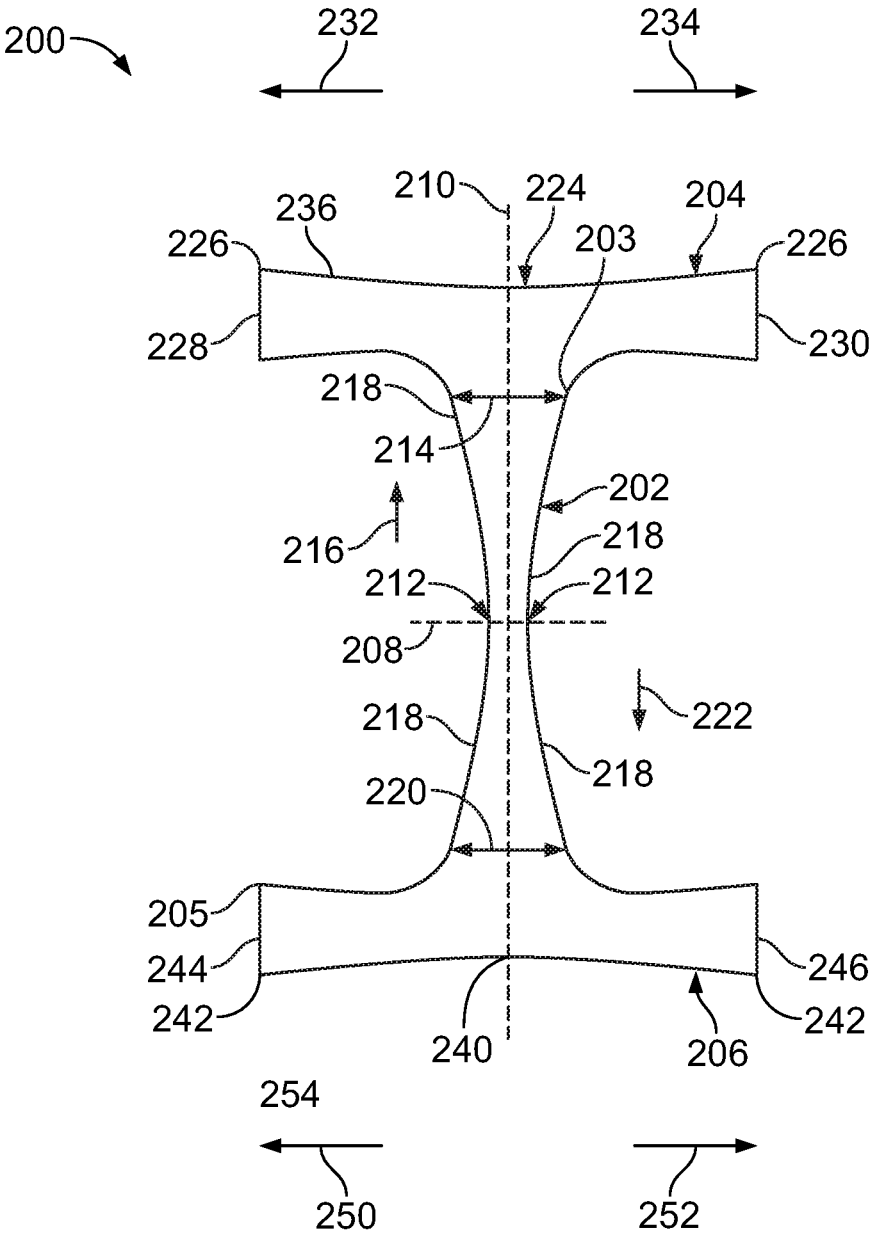
FIG. 2 illustrates an end view of an I-beam, according to an embodiment of the present disclosure.

FIG. 2 illustrates an end view of an I-beam 200, according to an embodiment of the present disclosure. The I-beam 200 includes a web 202 integrally formed with a first (or upper) flange 204 and a second (or lower) flange 206. The first flange 204 extends from a first end 203 of the web 202, and the second flange 206 extends from the second end 205 of the web 202. The first end 203 and the second end 205 are opposite from one another. A first neutral axis 208 extends through the web 202. The first neutral axis 208 may be a central transverse or horizontal axis of the I-beam 200. The first neutral axis 208 is a transverse axis or neutral axis X.

As shown, the first neutral axis 208 may be horizontally-oriented with respect to the orientation of the I-beam shown in FIG. 2.

A second neutral axis 210 extends through the first flange 204, the web 202, and the second flange 206. The second neutral axis 210 may be a central vertical axis of the I-beam 200. The second neutral axis 210 is a vertical axis or neutral axis Y. The first neutral axis 208 may be orthogonal to the second neutral axis 210. The first neutral axis 208 and the second neutral axis 210 may intersect within the web 202.

The web 202 outwardly expands away from the first neutral axis 208. That is, the thickness of the web 202 increases with increased distance from the first neutral axis 208. The thickness 212 of the web 202 at the first neutral axis 208 is minimal or otherwise reduced. The thickness 214 of the web 202 proximate to the first flange 204 is greater than the thickness 212. The thickness of the web 202 away from the first neutral axis 208 towards the first flange 204 in the direction of arrow 216 increases. As such, the web 202 outwardly flares or otherwise expands away from the first neutral axis 208 towards the first flange 204. In at least one embodiment, the thickness of the web 202 away from the first neutral axis 208 towards the first flange 204 may gradually, regularly, and uniformly increase. For example, the outer lateral surfaces 218 may have a constant outward slope or curvature away from the first neutral axis 208 towards the first flange 204. The thickness of the web 202 uniformly increases from the first neutral axis 208 to the first flange 204.

Similarly, the thickness 220 of the web 202 proximate to the second flange 206 is greater than the thickness 212. The thickness of the web 202 away from the first neutral axis 208 towards the second flange 206 in the direction of arrow 222 increases. As such, the web 202 outwardly flares or otherwise expands away from the first neutral axis 208 towards the second flange 206. In at least one embodiment, the thickness of the web 202 away from the first neutral axis 208 towards the second flange 206 may gradually, regularly, and uniformly increase. For example, the outer lateral surfaces 218 may have a constant outward slope or curvature away from the first neutral axis 208 towards the second flange 206. The thickness of the web 202 uniformly increases from the first neutral axis 208 to the second flange 206.

In at least one embodiment, the thicknesses 214 and 220 may be the same. Alternatively, the thickness 214 may be greater or less than the thickness 220.

The first flange 204 outwardly expands away from the second neutral axis 210. That is, the thickness of the first flange 204 increases with increased distance from the second neutral axis 210. The thickness 224 of the first flange 204 at the second neutral axis 210 is minimal or otherwise reduced. The thickness 226 of the first flange 204 at distal edges 228 and 230 is greater than the thickness 224. The thickness of the first flange 204 away from the second neutral axis 210 towards the distal edges 228 and 230 in the directions of respective arrows 232 and 234 increases. As such, the first flange 204 outwardly flares or otherwise expands away from the second neutral axis 210 towards the distal edges 228 and 230. In at least one embodiment, the thickness of the first flange 204 away from the second neutral axis 210 towards the distal edges 228 and 230 may gradually, regularly, and uniformly increase. For example, the exposed surfaces 236 of the first flange 204 may have a constant outward slope or curvature away from the second neutral axis 210 towards the distal edges 228 and 230. The thickness of the first flange uniformly increases from the second neutral axis 210 to the distal edges 228 and 230.

Similarly, the second flange 206 outwardly expands away from the second neutral axis 210. That is, the thickness of the second flange 206 increases with increased distance from the second neutral axis 210. The thickness 240 of the second flange 206 at the second neutral axis 210 is minimal or otherwise reduced. The thickness 242 of the second flange 206 at distal edges 244 and 246 is greater than the thickness 240. The thickness of the second flange 206 away from the second neutral axis 210 towards the distal edges 244 and 246 in the directions of respective arrows 250 and 252 increases. As such, the second flange 206 outwardly flares or otherwise expands away from the second neutral axis 210 towards the distal edges 244 and 246. In at least one embodiment, the thickness of the first flange 204 away from the second neutral axis 210 towards the distal edges 244 and 246 may gradually, regularly, and uniformly increase. For example, the exposed surfaces 254 of the second flange 206 may have a constant outward slope or curvature away from the second neutral axis 210 towards the distal edges 244 and 246. The thickness of the second flange uniformly increases from the second neutral axis 210 to the distal edges 244 and 246.

In at least one embodiment, the thicknesses 226 and 242 may be the same. Alternatively, the thickness 226 may be greater or less than the thickness 242.

As described, the I-beam 200 includes the web 202 having the first end 203 and the second end 205 opposite from the first end 203. The first flange 204 extends from the first end 203 of the web 202. The second flange 206 extends from the second end 205 of the web 202. The thickness of the web 202 increases away from the first neutral axis 208 towards the first flange 204 and the second flange 206. The web 202 at the first neutral axis 208 is the thinnest portion of the web 202. In at least one embodiment, a thickness of the first flange 204 increases away from the second neutral axis 210 towards first distal edges 228 and 230 of the first flange 204. The first flange 204 at the second neutral axis 210 is the thinnest portion of the first flange 204. In at least one embodiment, a thickness of the second flange 206 increases away from the second neutral axis 210 towards second distal edges 244 and 246 of the second flange 206. The second flange 206 at the second neutral axis 210 is the thinnest portion of the second flange 206.

The I-beam 200 may be integrally molded and formed. For example, the I-beam 200 may be integrally molded and formed as a single piece of diecast metal, such as steel, aluminum, iron, copper, or the like.

The I-beam 200 is a constant stress I-beam that has a non-uniform thickness along various axes. In contrast, a traditional I-beam having a constant thickness may not efficiently distribute forces, such as caused by stresses and strains. As force moves away from the neutral axes, the force increases along with the stress in the material. Embodiments of the present disclosure provide I-beam construction, such as the I-beam 200, having an outwardly expanding thickness away from one or more neutral axes, which distributes force at a constant rate throughout the I-beam 200. In at least one embodiment, the force is distributed by outwardly flaring or otherwise expanding (for example, increasing thickness) the material area at an even rate away from the first neutral axis 208 and the second neutral axis 210 towards outer extremities of the I-beam 200. Increasing thickness away from the first neutral axis 208 and/or the second neutral axis 210 distributes the force evenly over the sections, which also evenly distributes the stress of the material.

Increasing the thickness of the I-beam in the transverse direction away from a neutral axis such that out of vertical plane bending does not occur inhibits, prevents, or otherwise reduces buckling and twisting. Because the thickness and cross-sectional area of the I-beam increases in directions away from the neutral axes, the overall area and volume of the I-beam is increased, and stress exerted onto and/or into the I-beam is therefore distributed over a larger area. Consequently, the stress over the larger area is decreased.

Referring to FIGS. 1 and 2, certain components of the truck assembly 100 may have at least portions formed as at least portions of the I-beam 200. For example, one or both of the first side frame 106 or the second side frame 108 may have one or more portions formed as the I-beam 200. As another example, the bolster 110 may have one or more portions formed as the I-beam 200.

Figure 3:
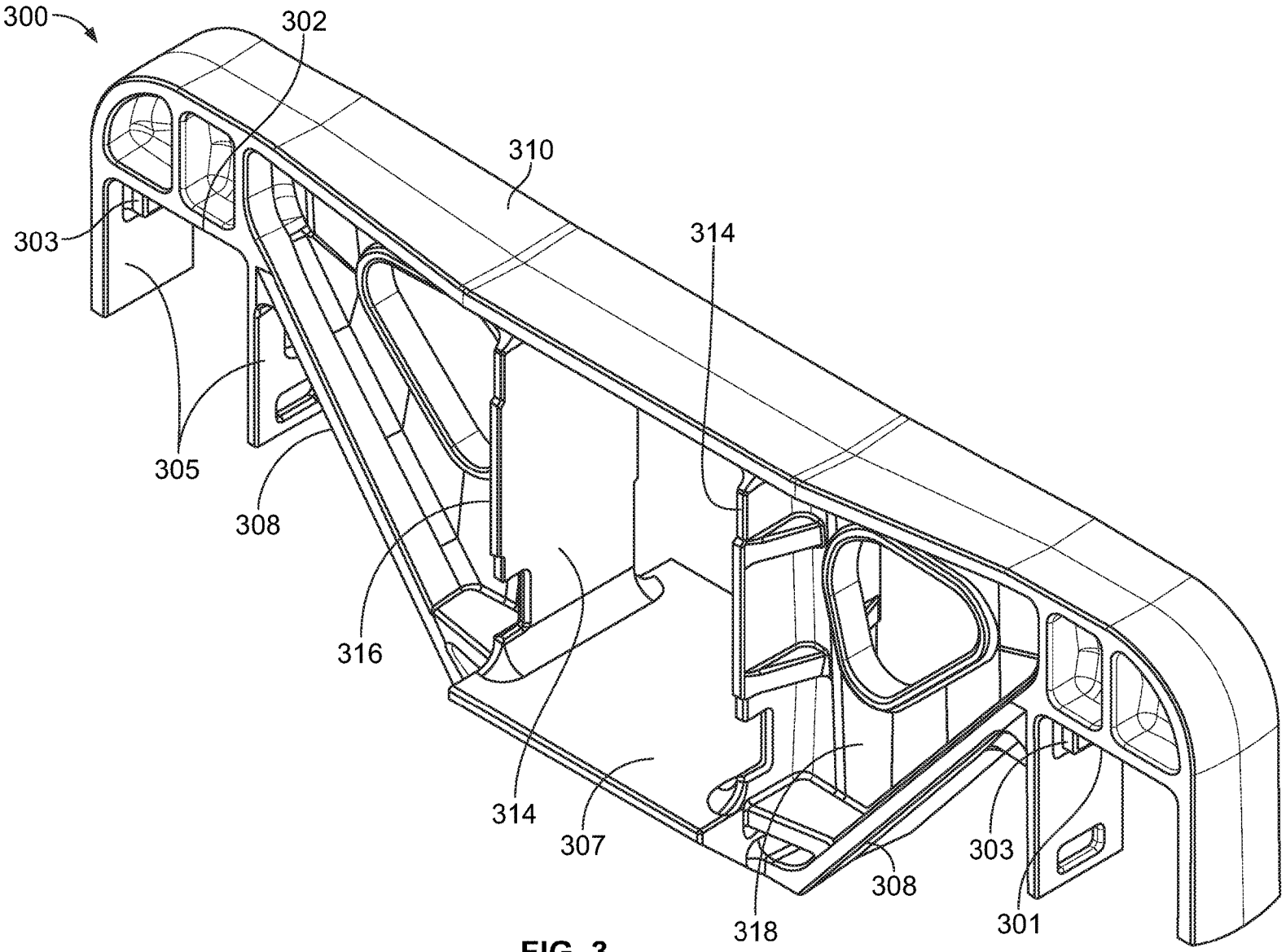
FIG. 3 illustrates a perspective top view of a side frame, according to an embodiment of the present disclosure.

FIG. 3 illustrates a perspective top view of a side frame 300, according to an embodiment of the present disclosure. Referring to FIGS. 1 and 3, one or both of the first side frame 106 or the second side frame 108 may be formed as the side frame 300. The side frame 300 may replace an existing side frame of a truck assembly.

The side frame 300 has pedestals 301, which include lugs 303 and jaws 305 configured to mate with components, such as wheel assemblies. Outwardly-flared (that is, away from neutral axes, as described herein) tension members 308 and outwardly-flared compression members 310 fit within a same envelope as a traditional side frame. A spring nest 307 is configured to retain load and control coils. Columns 314 may support wear plates or may be plasma coated with a wear resistant material. Sides of the columns 314 provide bolster lugs 316, which are protruding surfaces that interface with the bolster and keep the side frames in place. The side frame 300 also includes outwardly-flared (that is, away from one or more neutral axes) webs 318 that increase in thickness, as described with respect to FIG. 2, to uniformly distribute stress in relation to the tension members 308 and the compression members 310.

Figure 4:
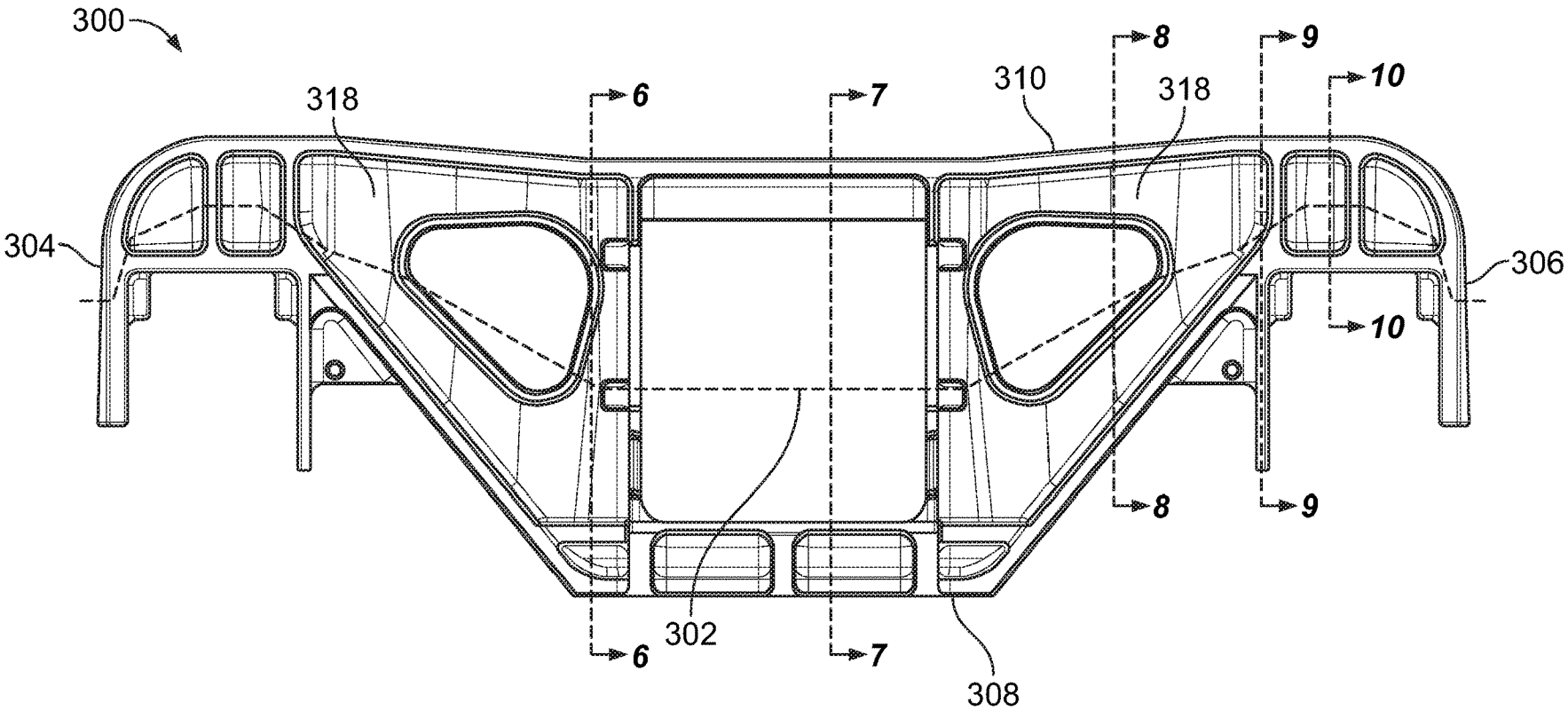
FIG. 4 illustrates a lateral view of the side frame.
Figure 5:
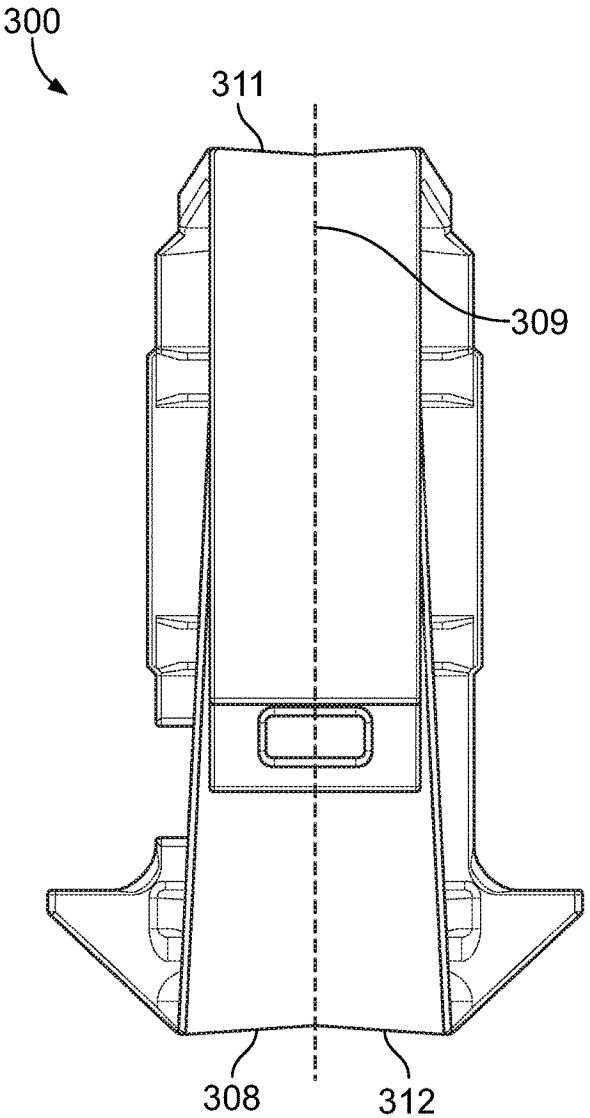
FIG. 5 illustrates an end view of the side frame.

FIG. 4 illustrates a lateral view of the side frame 300. FIG. 5 illustrates an end view of the side frame 300. Referring to FIGS. 4 and 5, a first neutral axis X 302 extends along a length of the side frame 300, such as from and between a first end 304 and a second end 306. A second neutral axis Y 309 is orthogonal to the first neutral axis X 302 and may extend along a length of the side frame 300 from and between a top 311 and a bottom 312. The neutral axis X 302 is the point where no bending occurs from vertical loads. In at least one embodiment, the neutral axis X 302 is the thinnest section of the webs 318. The tension members 308 and the compression members 310 may include outwardly-flared edges (that is, thicknesses increase away from the neutral axis Y 309).

The compression members 310 may provide a first flange of an I-beam construction, such as the first flange 204 of FIG. 2. The tension members 308 may provide a second flange of an I-beam construction, such as the second flange 206 of FIG. 2. The webs 318 may provide a web of an I-beam construction, such as the web 202 of FIG. 2. One or more features (such as channels, holes, protuberances, bends, and the like) may be formed in the compression members 310, the webs 318, and the tension members 308.

Figure 6:
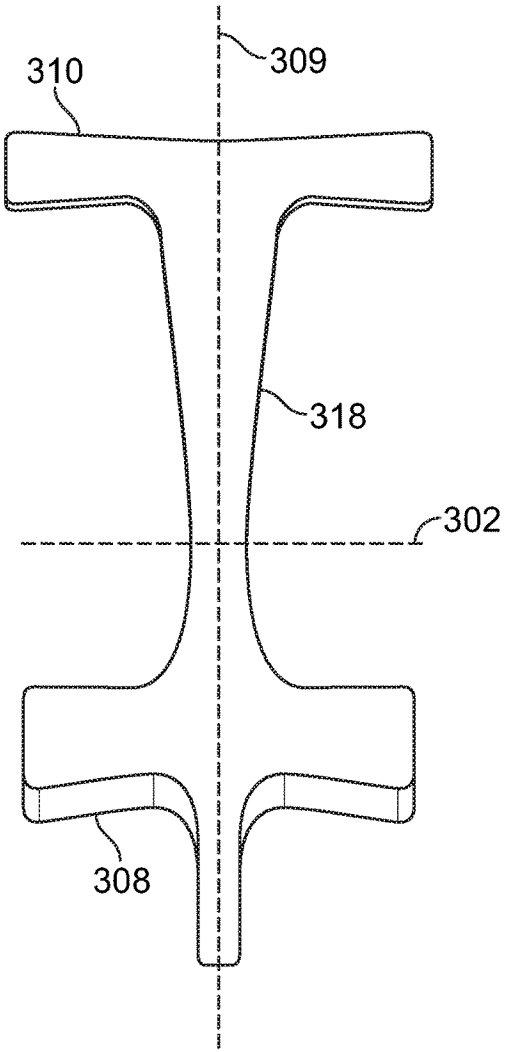
FIG. 6 illustrates a cross-sectional view of the side frame through line 6-6 of FIG. 4.

FIG. 6 illustrates a cross-sectional view of the side frame 300 through line 6-6 of FIG. 4. As shown, the side frame 300 is formed as an I-beam in which the web 318 outwardly expands (that is, increases in thickness) away from the neutral axis X 302 towards the tension member 308 and the compression member 310. Further, the tension member 308 and the compression member 310 outwardly expand (that is, increase in thickness) away from the neutral axis Y 309 towards distal edges.

Figure 10:
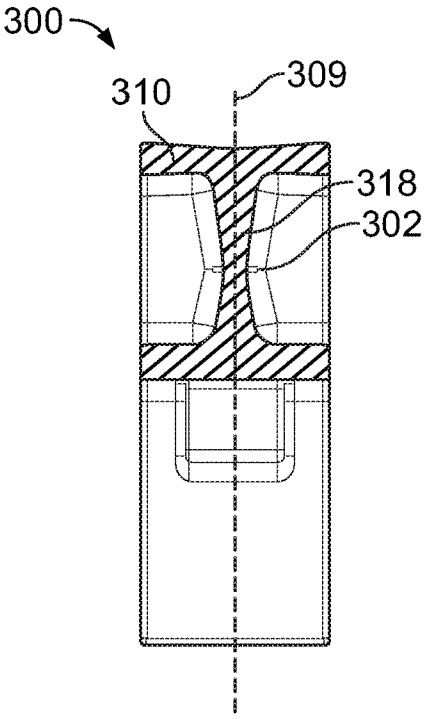
FIG. 10 illustrates a cross-sectional view of the side frame through line 10-10 of FIG. 4.
Figure 9:
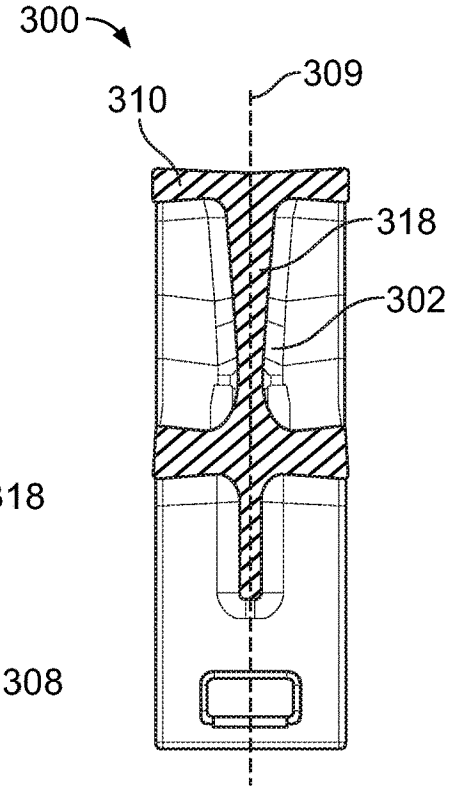
FIG. 9 illustrates a cross-sectional view of the side frame through line 9-9 of FIG. 4.
Figure 8:
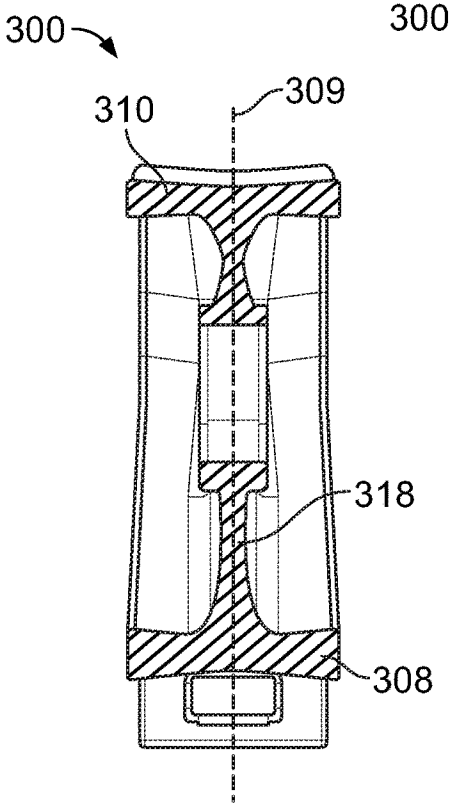
FIG. 8 illustrates a cross-sectional view of the side frame through line 8-8 of FIG. 4.
Figure 7:
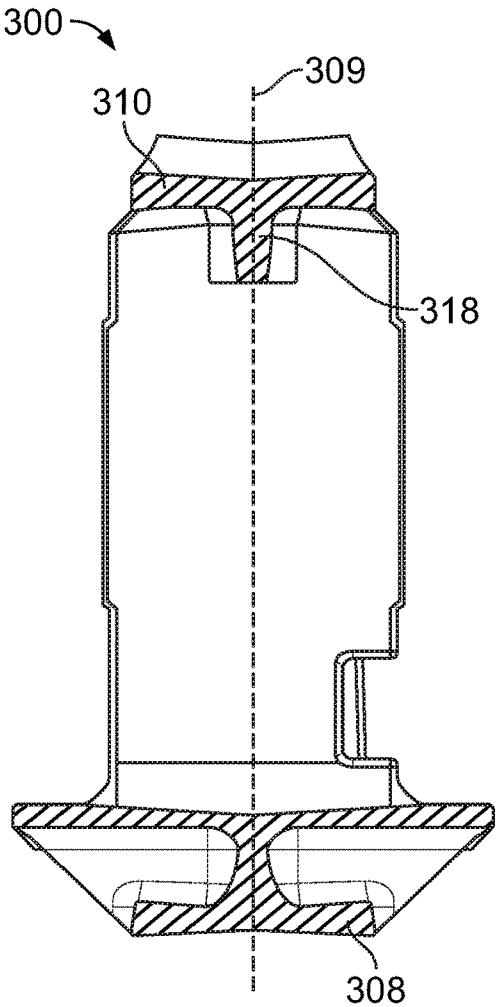
FIG. 7 illustrates a cross-sectional view of the side frame through line 7-7 of FIG. 4.

FIG. 7 illustrates a cross-sectional view of the side frame 300 through line 7-7 of FIG. 4. FIG. 8 illustrates a cross-sectional view of the side frame 300 through line 8-8 of FIG. 4. FIG. 9 illustrates a cross-sectional view of the side frame 300 through line 9-9 of FIG. 4. FIG. 10 illustrates a cross-sectional view of the side frame 300 through line 10-10 of FIG. 4. Referring to FIGS. 7-10, the web 318 is thinnest at and along neutral axis X 302, and outwardly expands away from the neutral axis X 302. Similarly, the tension member 308 and the compression member 310 outwardly expand away from the neutral axis Y 309.

As set forth herein, the constant stress side frame 300 provides several advantages over other side frames. For instance, the constant stress side frame 300 provides significant material and cost savings over other designs, because the manufacturing process involves less preparation and finish work. Moreover, the side frame 300 has surfaces that are more readily visible, allowing for a quicker and more accurate inspection. Moreover, the side frame 300 allows the manufacturing process to achieve greater accuracy in achieving the desired dimensions and tolerances, which can reduce or even eliminate the need to machine the finished product.

Portions of a truck assembly, such as the side frame 300, may be formed as an outwardly-expanding I-beam, as described herein. In at least one other embodiment, various other structures (such as brake guides, wear plates, portions of engine housings, and/or the like) may be formed as I-beams, as described herein.

Figure 11:
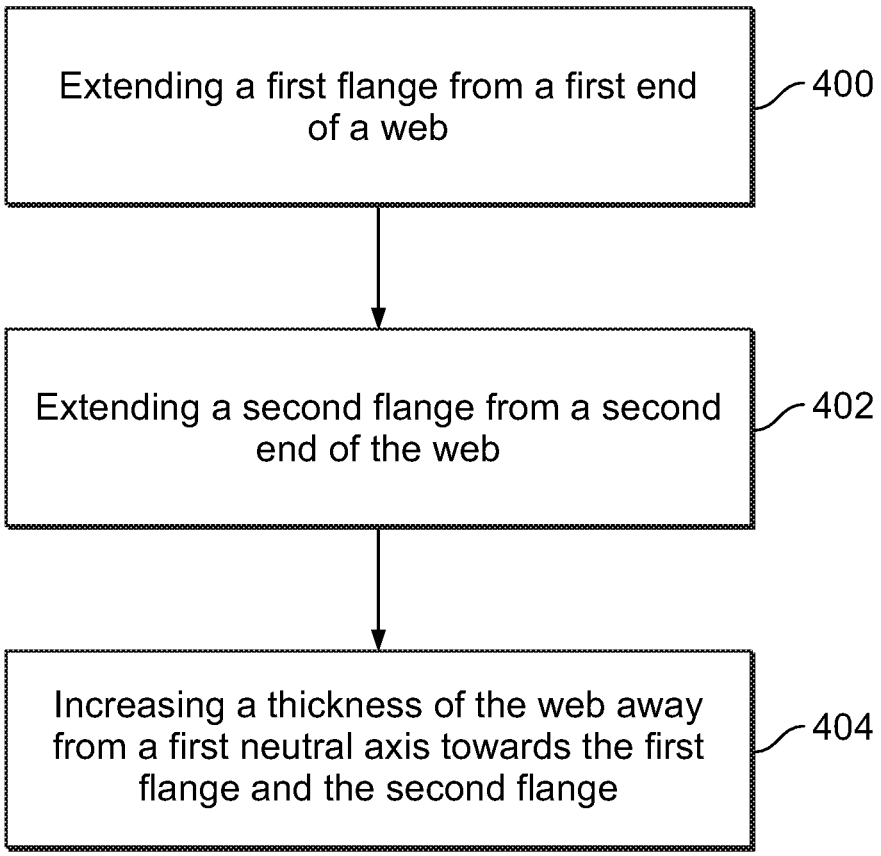
FIG. 11 illustrates a flow chart of a method of forming an I-beam, according to an embodiment of the present disclosure.

FIG. 11 illustrates a flow chart of a method of forming an I-beam, according to an embodiment of the present disclosure. The method include extending (400) a first flange from a first end of a web, extending (402) a second flange from a second end of the web (wherein the second end is opposite from the first end), and increasing (404) a thickness of the web away from a first neutral axis towards the first flange and the second flange.

The method may also include increasing a thickness of the first flange away from a second neutral axis towards first distal edges of the first flange. The method may also include increasing a thickness of the second flange away from the second neutral axis towards second distal edges of the second flange.

Figure 12:
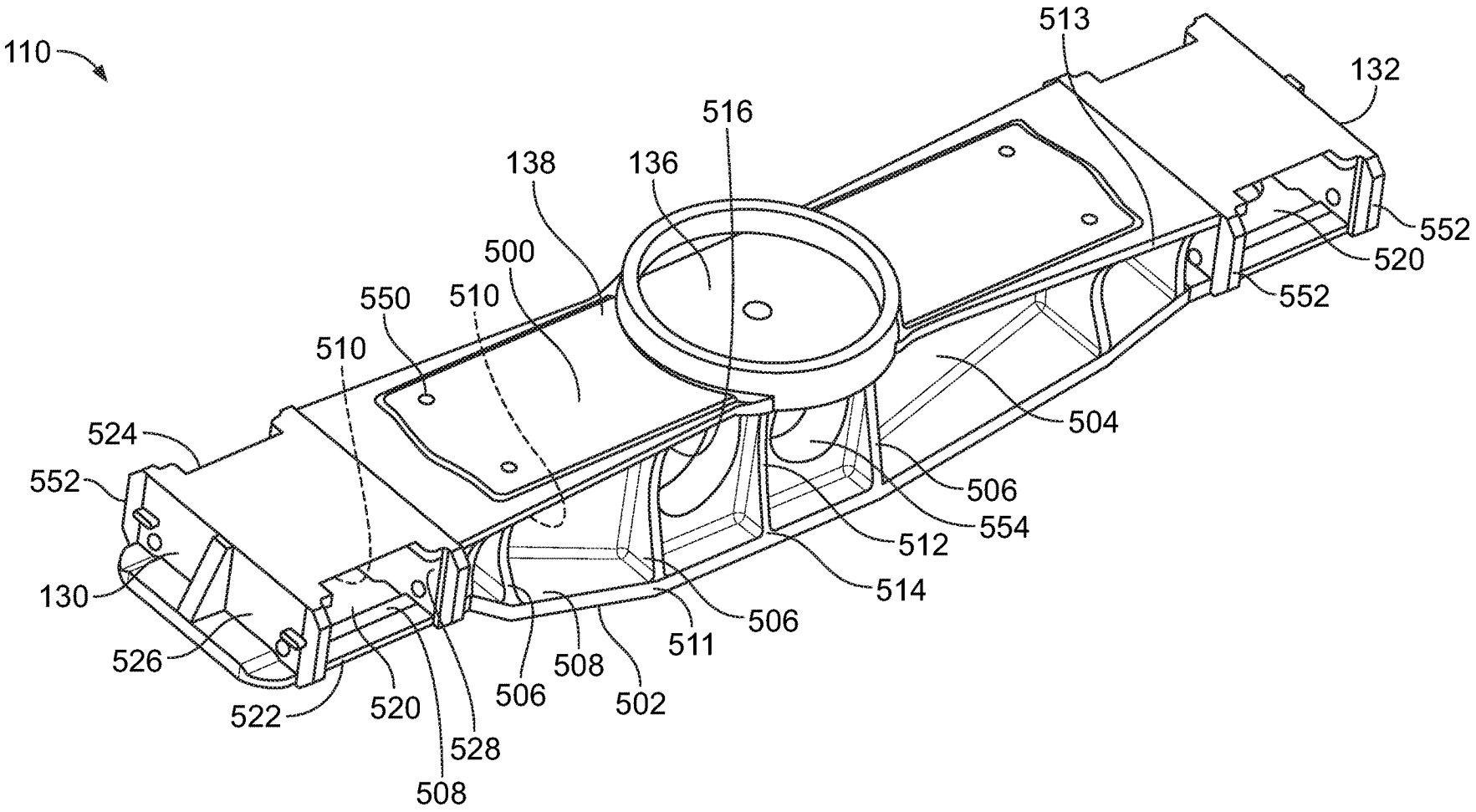
FIG. 12 illustrates a perspective top view of a bolster, according to an embodiment of the present disclosure.
Figure 13:
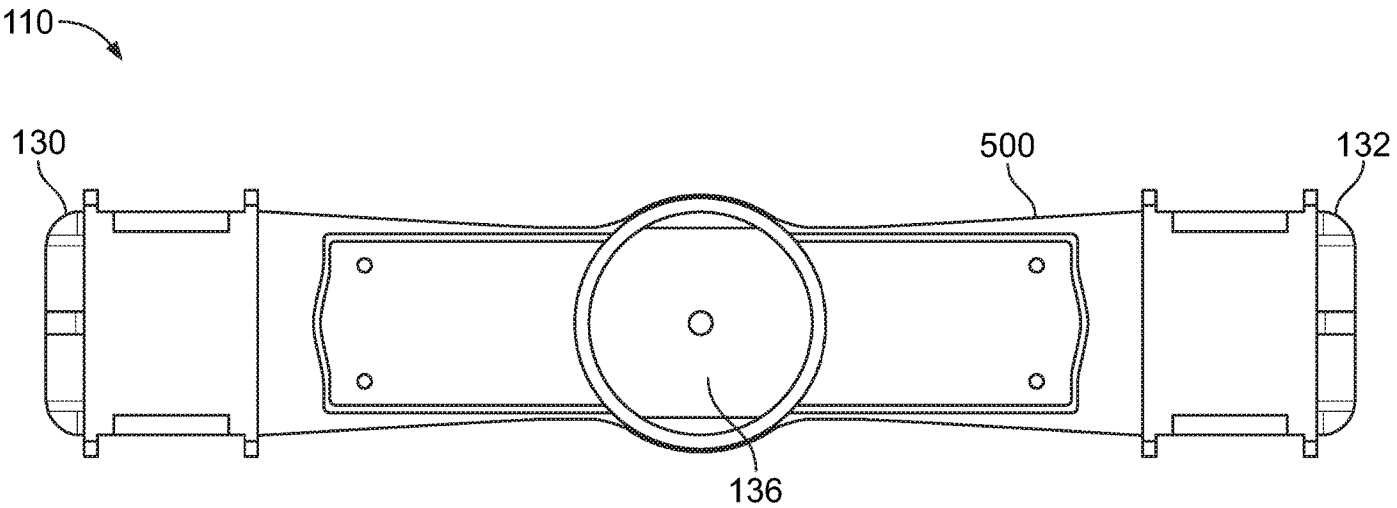
FIG. 13 illustrates a top view of the bolster.
Figure 14:
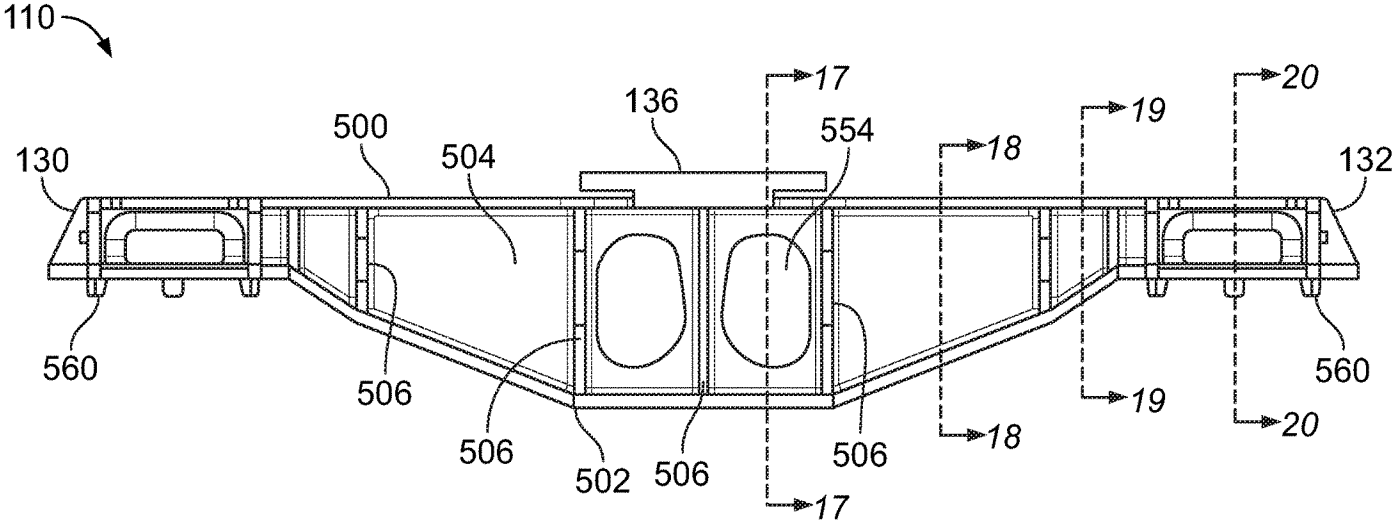
FIG. 14 illustrates a lateral view of the bolster.
Figure 15:
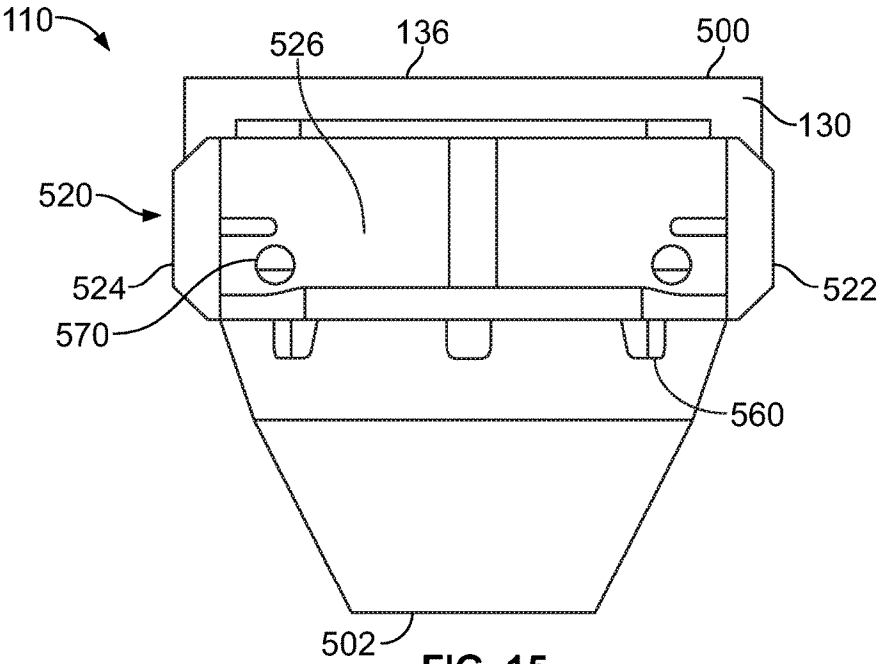
FIG. 15 illustrates an end view of the bolster.
Figure 16:
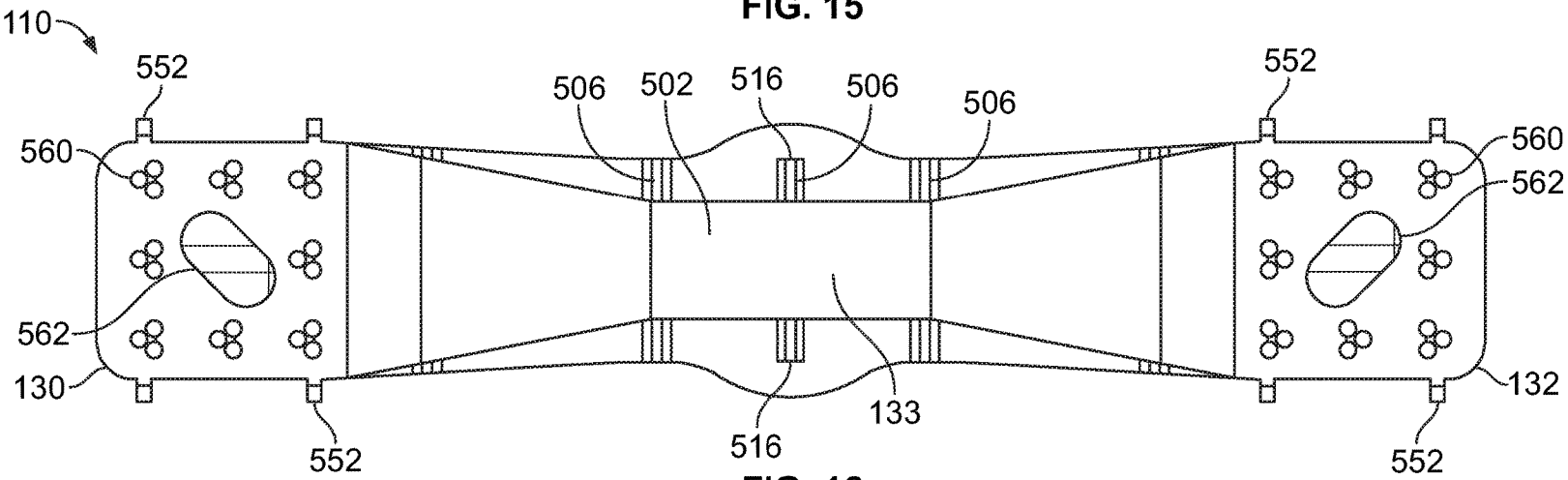
FIG. 16 illustrates a bottom view of the bolster.

FIG. 12 illustrates a perspective top view of the bolster 110, according to an embodiment of the present disclosure. FIG. 13 illustrates a top view of the bolster 110. FIG. 14 illustrates a lateral view of the bolster 110. FIG. 15 illustrates an end view of the bolster 110. FIG. 16 illustrates a bottom view of the bolster 110.

Referring to FIGS. 12-16, the bolster 110 includes the ends 130 and 132 (for example the first end 130 and the opposite second end 132). The bolster 110 also includes the bolster center bowl 136 outwardly extending from the upper surface 138.

The bolster 110 is formed having I-beam portions. In at least one embodiment, the bolster 110 is formed having an I-beam construction. For example, the bolster 110 includes a first or upper flange 500 connected to a second or lower flange 502 by a web 504. The first flange 500, the second flange 502, and the web 504 provide an I-beam configuration, such as shown in FIG. 2. That is, at least portions of the bolster 110 may be formed as shown and described with respect to FIG. 2.

In at least one embodiment, the web 504 is integrally formed with the first flange 500 and the second flange 502. One or more of the first flange 500, the second flange 502, or the web 504 may outwardly expand away from one or more neutral axes, as described with respect to FIG. 2. In at least one other embodiment, the first flange 500, the second flange 502, and the web 504 may not outwardly expand away from neutral axes.

In at least one embodiment, the bolster 110 also includes one or more stiffening gussets 506. The gussets 506 extend between an upper surface 508 of the second flange 502 and a lower surface 510 of the first flange 500. In at least one embodiment, the gussets 506 connect to the upper surface 508, the lower surface 510 and the web 504. The gussets 506 may extend through the web 504, or may extend from either side of the web 504.

In at least one embodiment, the gussets 506 are orthogonal to the web 504. For example, the gussets 506 connect to the web 504 at right angles. As shown, the gussets may outwardly expand from central portions 512 towards a junction 514 with the second flange 502 and a junction 516 with the first flange 500. In at least one embodiment, at least one of the gussets 506 may extend to outer edges 511 of the second flange 502 and/or outer edges 513 of the first flange 500, thereby providing increased bracing support.

The gussets 506 stiffen the bolster 110 and ensure that the first flange 500 and the second flange 502 remain structurally sound. That is, the gussets 506 provide stiffening members that eliminate, minimize, or otherwise reduce a potential of the first flange 500 and the second flange 502 from bending, warping, or the like. The gussets 506 eliminate, minimize, or otherwise reduce a potential of the first flange 500, the second flange 502, and the web 504 twisting out of plane.

Optionally, the bolster 110 may include more or less gussets 506 than shown. In at least one embodiment, the bolster 110 may not include any gussets.

Additionally, open shoe pockets 520 are formed in the ends 130 and 132. The shoe pockets 520 extend between and through a first side 522 and a second side 524 of the bolster 110. Each shoe pocket 520 is an open space defined between an end wall 526, an upper surface 508 of the second flange 502, the lower surface 510 of the first flange 500, and (optionally) an internal wall 528 opposite the end wall 526. The shoe pockets 520 provide spaces for friction shoes to be disposed. The friction shoes may be quickly and efficiently urged into and secured within the shoe pockets 520. The shoe pockets 520 allow for an efficient manufacturing process, as there is no need to form internally-sloped walls within the bolster 110 to accommodate friction shoes.

Side-bearing attachment holes 550 may be formed into the first flange 500. The side-bearing attachment holes 550 provide attachment locations for the side bearings 160*a* and 160*b*, as shown in FIG. 1. The ends 130 and 132 may also include retaining gibs 552. The gibs 552 are configured to couple the bolster 110 to the side frames 106 and 108, as shown in FIG. 1. The web 504 may include one or more apertures 554, such as may be used to accommodate rods, brake rigging, and/or the like.

Spring bosses 560 may downwardly extend from lower surfaces of the second flange 502 at the ends 130 and 132. The spring bosses 560 are configured to couple to and secure load coils 148, such as shown in FIG. 1.

Further, as shown in FIG. 16, control coil apertures 562 may be formed through the second flange 502. The control coil apertures 562 allow the control coils 150 to extend into the shoe pockets 520 and couple to friction shoes therein.

As also shown in FIG. 16, the second flange 502 may internally taper from the ends 130 and 132 towards a center 133. The tapering distributes material stress evenly over the second flange 502.

As shown in FIG. 15, pin holes 570 may be formed in the ends 130 and 132 within the end walls 526. The pin holes 570 are attachment locations that are configured to securely retain fasteners or portions of the friction shoes to secure the friction shoes within the shoe pockets 520.

Figure 17:
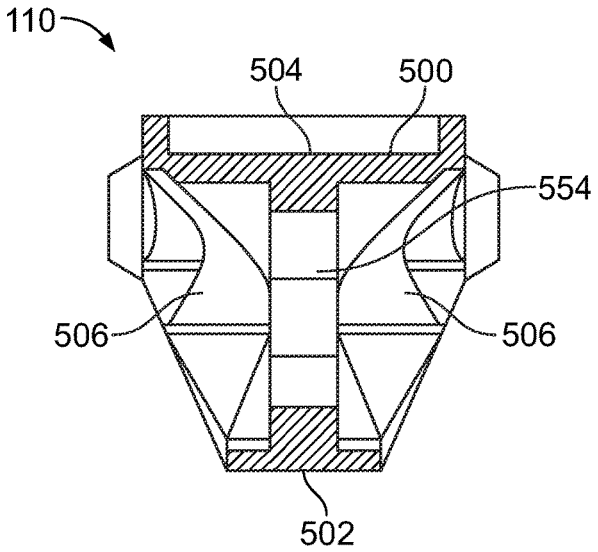
FIG. 17 illustrates a cross-sectional view of the bolster through line 17-17 of FIG. 14.

FIG. 17 illustrates a cross-sectional view of the bolster 110 through line 17-17 of FIG. 14. The aperture 554 is formed in the web 504. The gussets 506 laterally extend away from the web 504.

Figure 18:
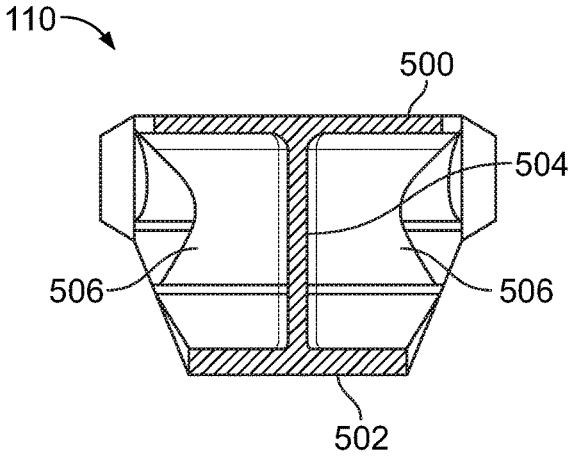
FIG. 18 illustrates a cross-sectional view of the bolster through line 18-18 of FIG. 14.
Figure 19:
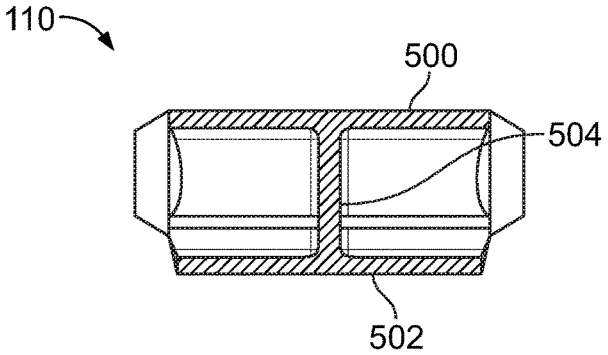
FIG. 19 illustrates a cross-sectional view of the bolster through line 19-19 of FIG. 14.

FIG. 18 illustrates a cross-sectional view of the bolster 110 through line 18-18 of FIG. 14. FIG. 19 illustrates a cross-sectional view of the bolster 110 through line 19-19 of FIG. 14. The first flange 500, the second flange 502, and the web 504 may or may not outwardly expand away from one or more neutral axes.

Figure 20:
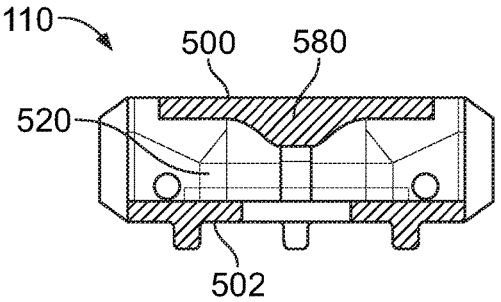
FIG. 20 illustrates a cross-sectional view of the bolster through line 20-20 of FIG. 14.

FIG. 20 illustrates a cross-sectional view of the bolster 110 through line 20-20 of FIG. 14. As shown in FIG. 20, a central section 580 of the first flange 500 may extend downwardly towards the second flange 502 within the shoe pocket 520. The thickened central section 580 provides increased securing support within the shoe pocket 520. The thickened central section 580 may provide increased securing area for a friction shoe within the shoe pocket 520.

Referring to FIGS. 12-20, certain embodiments of the present disclosure provide a method of forming the bolster 110 for a truck assembly that is configured to travel along a track having rails. The method includes integrally forming the bolster 110 with the first flange 500, the second flange 502, and the web 504. The integrally forming provides an I-beam.

The method may also include extending one or more gussets 506 between the first flange 500 and the second flange 502. In at least one embodiment, the extending includes connecting the gussets 506 to the web 504. The extending may include orthogonally disposing the gussets 506 in relation to the web. The extending may include expanding the gussets 506 from central portions 512 towards the junction 516 with the first flange 500 and the junction 514 with the second flange 502. The extending may include extending the gussets 506 to outer edges of one or both of the first flange 500 or the second flange 502.

In at least one embodiment, the method also includes forming a first shoe pocket 520 at the end 130 of the bolster 110. The first shoe pocket 520 is configured to receive and retain a first friction shoe. The method may also include forming a second shoe pocket 520 at the end 132 of the bolster 110. The second shoe pocket 520 is configured to receive and retain a second friction shoe.

As described herein, embodiments of the present disclosure provide a railway truck assembly having components, such as the side frames and bolster, which may be efficiently formed. Further, embodiments of the present disclosure provide a railway truck assembly having components that are robust and reliable. Moreover, embodiments of the present disclosure provide I-beams that efficiently carry bending and shear loads in a plane of a web, as well as an increased capacity in a transverse direction.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A bolster for a truck assembly, wherein the truck assembly is configured to travel along a track having rails, the bolster comprising:

a first shoe pocket formed at a first end, wherein the first shoe pocket is configured to receive and retain a first friction shoe; and a second shoe pocket at a second end, wherein the second shoe pocket is configured to receive and retain a second friction shoe;

a first flange;

a second flange; and a web connecting the first flange to the second flange, wherein the first flange, the second flange, and the web form an I-beam.

2. The bolster of claim 1, further comprising one or more gussets extending between the first flange and the second flange.

3. The bolster of claim 2, wherein the one or more gussets connect to the web.

4. The bolster of claim 2, wherein the one or more gussets are orthogonal to the web.

5. The bolster of claim 2, wherein the one or more gussets expand from a central portion towards a first junction with the first flange and a second junction with the second flange.

6. The bolster of claim 2, wherein the one or more gussets extend to outer edges of one or both of the first flange or the second flange.

7. The bolster of claim 1, wherein a thickness of the web increases away from a first neutral axis towards the first flange and the second flange.

8. The bolster of claim 1, wherein a thickness of the first flange increases away from a second neutral axis towards first distal edges of the first flange.

9. The bolster of claim 1, wherein a thickness of the second flange increases away from the second neutral axis towards second distal edges of the second flange.

10. The bolster of claim 1, wherein outer surfaces of the web have a constant outward slope or curvature from and away a first neutral axis towards the first flange and the second flange.

11. The truck assembly of claim 1, wherein outer surfaces of the web have a constant outward slope or curvature from and away a first neutral axis towards the first flange and the second flange.

12. A method of forming a bolster for a truck assembly, wherein the truck assembly is configured to travel along a track having rails, the method comprising:

integrally forming the bolster with a first flange, a second flange, and a web, wherein the integrally forming provides an I-beam;

forming a first shoe pocket at a first end of the bolster, wherein the first shoe pocket is configured to receive and retain a first friction shoe; and forming a second shoe pocket at a second end of the bolster, wherein the second shoe pocket is configured to receive and retain a second friction shoe.

13. The method of claim 12, further comprising extending one or more gussets between the first flange and the second flange.

14. The method of claim 13, wherein the extending comprises connecting the one or more gussets to the web.

15. The method of claim 13, wherein the extending comprises orthogonally disposing the one or more gussets in relation to the web.

16. The method of claim 13, wherein the extending comprises expanding the one or more gussets from a central portion towards a first junction with the first flange and a second junction with the second flange.

17. The method of claim 13, wherein the extending comprises extending the one or more gussets to outer edges of one or both of the first flange or the second flange.

18. The method of claim 12, further comprising uniformly increasing a thickness of the web away from a first neutral axis towards the first flange and the second flange, wherein the first neutral axis is between the first flange and the second flange, wherein said uniformly increasing comprises providing outer surfaces of the web with a constant slope or curvature from and away the first neutral axis towards the first flange and the second flange.

19. A truck assembly that is configured to travel along a track having rails, the truck assembly comprising:

a first side frame;

a second side frame; and a bolster extending between the first side frame and the second side frame, the bolster comprising:

a first flange;

a second flange;

a web connecting the first flange to the second flange, wherein the first flange, the second flange, and the web form an I-beam;

one or more gussets extending between the first flange and the second flange, wherein the one or more gussets connect to the web, wherein the one or more gussets are orthogonal to the web, and wherein the one or more gussets expand from a central portion towards a first junction with the first flange and a second junction with the second flange; and a first shoe pocket formed in first end, wherein the first shoe pocket is configured to receive and retain a first friction shoe; and a second shoe pocket at a second end, wherein the second shoe pocket is configured to receive and retain a second friction shoe.

20. The truck assembly of claim 19, wherein a thickness of the web increases away from a first neutral axis towards the first flange and the second flange.

21. The truck assembly of claim 20, wherein a thickness of the first flange increases away from a second neutral axis towards first distal edges of the first flange, and wherein a thickness of the second flange increases away from the second neutral axis towards second distal edges of the second flange.

* * * * *